United States Patent [19]

Holzner et al.

[11] Patent Number: 4,785,833

[45] Date of Patent: Nov. 22, 1988

[54] PROCESS FOR THE AROMATIZATION OF TOBACCO

[75] Inventors: Günter Holzner, Grand-Lancy; Gérald Uhde, Confignon; Giuseppe Salvadori, Satigny, all of Switzerland

[73] Assignee: Firmenich S.A., Geneva, Switzerland

[21] Appl. No.: 7,855

[22] Filed: Jan. 28, 1987

[30] Foreign Application Priority Data

Feb. 5, 1986 [CH] Switzerland ..... 438186

[51] Int. Cl.[4] ..... A24B 3/12

[52] U.S. Cl. ..... 131/310; 131/309

[58] Field of Search ..... 131/275, 276, 309, 310

[56] References Cited

U.S. PATENT DOCUMENTS 3,280,823 10/1966 Bavley et al. .
3,550,598 12/1970 McGlumphy et al. .
3,603,319 9/1971 Badgett et al. .
3,623,489 11/1971 Quinn .
4,339,422 7/1982 Cheng .

FOREIGN PATENT DOCUMENTS 0011324 5/1980 European Pat. Off. .
0070719 1/1983 European Pat. Off. .
2175236 10/1973 France .

*Primary Examiner*—Vincent Millin
*Attorney, Agent, or Firm*—Pennie & Edmonds

[57] ABSTRACT

Process for the aromatization of tobacco leaves or tobacco particles, powder or sheets of natural or artificial origin by means of a volatile, water immiscible active flavor, which process is characterized in that the said flavor is put into intimate contact with the tobacco leaves, particles, powder or sheets by directly spraying onto their exposed surface an emulsion consisting of the said flavor, an aqueous solution of a hydrosoluble carrier and an emulsifier.

6 Claims, No Drawings

PROCESS FOR THE AROMATIZATION OF TOBACCO

BRIEF SUMMARY OF THE INVENTION

The present invention relates to the field of the aromatization of tobacco. More particularly, it relates to a process for the aromatization of tobacco leaves or tobacco particles, powder or sheets of natural or artificial origin by means of a volatile, water-immiscible active flavor, which process is characterized in that the said flavor is put into intimate contact with the tobacco leaves, particles, powder or sheets by directly spraying onto their exposed surface an emulsion consisting of the said flavor, an aqueous solution of a hydrosoluble carrier and an emulsifier.

The instant invention provides further a smoking or a chewing article essentially consisting of a tobacco material flavored according to the above described process.

BACKGROUND OF THE INVENTION

According to a current practice, the tobacco industry makes extensive use of a variety of flavoring active materials to improve the organoleptic properties of the different sorts of tobaccos it normally utilizes to manufacture a wide range of consumable articles. Tobacco aromatization has been carried out in the past according to several different techniques and methods, two methods though have acquired general acceptance: the soaking of tobacco in a solution, typically an aqueous one, of the flavor and the spraying of an aqueous or alcoholic solution of the flavor onto the tobacco.

The main drawback of these methods is that the active aromatic components of the flavor composition used, which generally consists in a variety of ingredients of different chemical constitution, possess in most of the cases a high vapor pressure already at room temperature and that consequently they tend to evaporate from the surface of the treated product shortly after the treatment.

In order to overcome this disadvantage, several techniques of flavor encapsulation have been suggested. U.S. Pat. No. 3,550,598 describes a process which consists in spraying the tobacco product with a suspension of hydrosoluble flavor entrapping capsules. This method has been applied in particular to the manufacture of reconstituted tobacco sheets using tobacco fines and dust accumulated in tobacco processing operations.

U.S. Pat. No. 3,623,489 describes a process for the aromatization of shredded tobacco which consists in the addition thereto of rupturable microcapsules incorporating a synthetic clove flavoring material. The capsules are of such a size as to create an audible crackling sound when burned liberating at the same time the active flavor volatile, generally eugenol. This patent suggests that the microcapsules can be manufactured according to any known current technique.

Other aromatization methods have been suggested in the past, none of them however has encountered sofar any major interest. In this respect, one may cite the addition of the flavorant to a polymeric element destined to be incorporated into a cigarette filter (U.S. Pat. No. 3,603,319) or the utilization of a cationic or anionic exchange resin having the property of being able to bind to certain molecules of basic or acid flavoring material (U.S. Pat. No. 3,280,823).

The prior art is rich in specific examples concerning the aromatization of foodstuffs by microencapsulation.

Among the most recently published ones, attention is drawn to European Pat. No. 11 324, U.S. Pat. No. 4,339,422 and European Pat. No. 70 719. All these documents describe processes for the preparation of microcapsules by a technique known under the designation of "bed fluidization". More particularly, European Pat. No. 70 719 describes an encapsulation process for volatile liquids which consists in the agglomeration of the volatile liquid in a solution of a carrier material onto fluidized solid particles. The resulting solid capsules of substantially greater than those which can be made in small spray-drying towers entrap the active volatile liquids and can be utilized in aromatize consumable materials by direct addition thereto.

Bed fluidization is a technique which has encountered wide acceptability within the industry. This technique requires however a constant severe control of all the intervening physical parameters and cannot be applied to any and all materials. On the other hand, in many instances it has become apparent that the thus obtained solid particles containing the active flavor tend to mix in a non-uniform manner when added to the material to be flavored, a situation which may give rise to unhomogeneous aromatization.

THE INVENTION

In an attempt to overcome this disadvantage, we have discovered a novel, simple and original method to aromatize tobacco, irrespectively under the form of leaves, particles, powder or films. The method of the present invention consists in putting into intimate contact a flavor by way of spraying onto the exposed surface of a tobacco leaf, particle, powder or film an emulsion consisting of the said flavor, an aqueous solution of a hydrosoluble carrier and an emulsifier.

The volatile flavoring material does first adhere on the surface of the tobacco leaves, particles or film, thanks to the binding property of the chosen carrier. Under the influence of subsequent drying, which occurs on simple gradual exposure of the treated tobacco to air or to an external source of heat, optionally by applying a slight suction or ventilation, the flavor is held on the surface of the treated tobacco under the form of minute droplets coated by a hydrosoluble protecting layer resulting by the drying of the carrier material.

This process presents the obvious advantage of providing a flavored tobacco whose aroma quality remains practically constant during subsequent processing or storage, flavor release occurring only upon smoking or chewing.

The process of the invention does not require any special equipment. In fact, contrary to known methods, it does not necessitate spray-dryers or fluidized bed apparatus or agglomerators. The whole operation is carried out at room temperature and it is therefore economical to run. In most of the cases it becomes even unnecessary to effect the drying of the treated tobacco. The water present in the emulsion is in fact completely and readily absorbed by the tobacco so as to maintain the correct degree of required humidity.

Suitable carrier materials for use in the instant invention include polyvinyl acetate (PVA), polyvinyl alcohol, natural or modified dextrins, natural or modified starches, vegetal gums, natural or modified proteins, alginates, carrageenans, pectins, xanthanes or cellulose derivatives such as for example carboxymethylcellulose, methylcellulose and hydroxymethylcellulose.

These hydrosoluble carriers can be used either alone or in the form of a mixture.

Preferred carriers include gum arabic, gum laquier, maltodextrins, starch and partially hydrolized proteins.

Suitable emulsifiers for use in this invention include fatty acids mono- or diglycerides, esters of fatty acids with sorbitol or with a saccharide, or ester derivatives of tartaric acid, citric acid, ascorbic acid or lactic acid.

According to this invention, the emulsion containing the flavor is sprayed onto the tobacco by means of a common sprayer, for instance a compressed air sprayer. Pressure can be varied depending on the viscosity of the emulsion, on the flow rate desired and on the nature of the tobacco product to be treated.

Typically a pressure of 2 to 10 bar, preferably of 3 to 5 bar, is perfectly adapted to most of the cases examined.

According to a preferred embodiment of the invention, a "Venturi" type sprayer is used with an air pressure value of about 4 bar. The spray nozzle has a diameter of 4 to 8 mm whereas the nozzle for liquid aspiration has a diameter of 0.6–0.9 mm. Emulsion flow rate is of about 10 to 40 g/minute. The application of the emulsion of the tobacco product to be treated can be effected by laying out the product on a flat surface, for instance by spreading the product on the surface of a moving belt or by rotating it in a rotatory drum, this will enable an homogeneous coating of the exposed surface of the tobacco product.

As indicated above, the water present in the flavor emulsion is readily adsorbed by tobacco and/or evaporated from its surface already at room temperature. However, if the emulsion had to increase the amount of water in tobacco to a value of beyond 10–15% by weight, the sprayed tobacco could be dried in an oven by applying a moderate heat, e.g. 40° C. during 10 to 20 minutes.

The respective weight proportions of the different ingredients of the emulsion can vary within a wide range. Preferred proportions are a. from 0.5 to 20% of the active flavor, b. from 5 to 30% of the hydrosoluble carrier, c. from 0.1 to 10% of the emulsifier, and d. the remainder is water The process of this invention offers important benefit when compared to known methods to aromatize tobacco. In effect, it consists in a "direct" process which differs from the "indirect" encapsulation techniques of the art: the process is therefore more economical to run. Compared to the traditional methods followed by the industry, such as the spraying of tobacco with a flavor alcoholic solution, the process of this invention is more efficient and more reliable. The dispersion of the volatile active materials in the environment during the spraying operation is reduced and this in turn implies that the resulting product results more homogeneously flavored, more balanced. An additional important benefit of this invention is that the thus flavored tobacco keeps significantly constant its flavor quality for an extensive period of time, the flavor active materials being protected from the action of external influences such as evaporation or oxidation.

The process of this invention can be applied both to tobacco of natural origin and to reconstituted or artificial tobacco. The spraying of the emulsion can be carried out indifferently during any step of tobacco processing, either on the leaves or on shredded tobacco particles, fines, dust, or film.

Suitable flavors to be used in the process of the instant invention include a very wide range of flavoring materials. In principle, any ingredient known to improve, enhance or modify the taste and aroma of tobacco can be used in connection with this invention. A great variety of chemicals and natural essential oils are available for tobacco aromatization. Among the preferred materials one may cite those reported in French Pat. No. 2,175,236. Their concentration in the emulsion depends on the nature of the product to be treated and of course on the specific flavor effect it is desired to achieve. Concentrations of the order of 10 to 100–200 ppm (parts per million) by weight based on the weight of the flavored tobacco are generally considered as satisfactory.

The invention is illustrated by but not limited to the following examples.

EXAMPLE 1

A flavoring composition of tobacco type (origin: Firmenich SA, Geneva: Tabac 52.644) was incorporated at a concentration of 1% by weight in an emulsion obtained by mixing the following ingredients (parts by weight):

| | |
|---|---|
| Malto-dextrin(1) (Maltrin-Glucidex, registered tradename) | 225 |
| Manucol(2) LF | 5 |
| Demineralized water | 770 |
| Total | 1000 |

(1)a 10:90 mixture of maltodextrins (orgin: Roquette Freres, Beinheim, France and Grain Processing Co., Muscatine, Iowa, USA);

(2)sodium alginate (orgin: Alginate Industries Ltd., Great-Britain). The viscosity of the mixture was of 72 cps.

100 G of the aromatic emulsion thus obtained was sprayed by means of a "Venturi" type sprayer over 1000 g of shredded tobacco of american blend type. The thus flavored tobacco was left at room temperature in a normally ventilated room during 8 weeks, whereupon it was used to manufacture 'test'-cigarettes the smoke of which was evaluated by a panel of experienced flavorists. By comparison with the smoke of 'control'-cigarettes aromatized by spraying tobacco with an alcoholic solution of the flavor composition (100 g of the flavor solution at 1% in 95% ethanol over 1000 g of tobacco), the panel observed that the 'test'-cigarettes developed a more distinct and harmonious aroma; they developed moreover a more intense side-stream effect.

EXAMPLE 2

A flavor composition of Virginia type tobacco (origin: Firmenich SA, Geneva: Tabac 53.476) was incorporated at a concentration of 0.5% by weight in an emulsion prepared as indicated in example 1.

100 G of the aromatic emulsion thus obtained was sprayed on tobacco as indicated in the previous example and the resulting flavored material was used to manufacture 'test'-cigarettes, wheres 'control'-cigarettes were prepared by using tobacco aromatized by classical spraying of the flavor alcoholic solution.

A panel of experts found that the aroma developed by the 'test'-cigarettes possessed a richer note than the 'control'-cigarettes. On the other hand, the harsh and irritating character of the tobacco was substantially reduced.

EXAMPLE 3

A flavor composition of fruity type, destined to tobacco mixtures consisting of "flue-" and "air-cured" tobaccos with oriental tobaccos, (origin: Firmenich SA, Geneva: Tabac 53.911) especially intended for manufacturing kreteks (cigarettes of Indonesian type) was incorporated at a concentration of 1% by weight into an emulsion prepared as indicated in example 1.

The 'test'-cigarettes prepared and evaluated as indicated in the previous examples developed a marked fruity character reminiscent of ripe banana with a slight tonality of dry fruits.

EXAMPLE 4

The flavor composition used in example 3 above (Tabac 53.911, Firmenich SA) was incorporated at a concentration of 1% by weight into an emulsion obtained by mixing the following ingredients (parts by weight):

| | |
|---|---|
| Gum arabic | 50 |
| Malto-dextrin(1) (Maltrin-Glucidex, registered tradename) | 200 |
| Manucol(2) LF | 2 |
| Gelatine | 40 |
| Hydrokollan(3) $PP_4$ | 50 |
| Demineralized water | 658 |
| Total | 1000 |

(1)a 10:90 mixture of maltodextrins (orgin: Roquette Freres, Beinheim, France and Grain Processing Co., Muscatine, Iowa, USA);
(2)sodium alginate (orgin: Alginate Industries Ltd., Great-Britain).
(3)collagene hydrolysate (orgin: Friedrich Naumann, Memmingen, RFA).

'Test'- and 'control'-cigarettes were then manufactured as indicated in example 1 by using the resulting flavoring emulsion and an alcoholic solution of the flavoring compositions, respectively. The evaluation carried out by a panel of flavor experts indicated that the smoke of the 'test'-cigarettes possessed a dry fruit character and a slight carmel note, well distinct over that of the 'control'-cigarettes.

EXAMPLE 5

The flavor composition described in example 3 above (Tabac 53.911, Firmenich SA) was incorporated at a concentration of 1% by weight into an emulsion obtained by mixing the following ingredients (parts by weight):

| | |
|---|---|
| Gum arabic | 12 |
| Malto-dextrin(1) (Maltrin-Glucidex, registered tradename) | 100 |
| Manucol(2) LF | 2 |
| Capsul(3) | 100 |
| Arlacel(4) 20 | 50 |
| Hydrokollan(5) $PP_4$ | 50 |
| Demineralized water | 686 |
| Total | 1000 |

(1), (2) and (5) see example 4
(3)modified corn starch (orgin: National Starch and Chemical Corp., Bridgewater, N.J., USA)
(4)sorbitol laurate (orgin: Atlas Chemical Industries N.V. Everberg, Belgium)

'Test'- and 'control'-cigarettes were manufactured as indicated in example 1 by using the resulting flavoring emulsion and an alcoholic solution of the flavoring composition, respectively. A panel of experts found that the smoke of the 'test'-cigarettes possessed a dry fruit character and a typical note of ripe banana. The aroma developed by the smoke of the 'control'-cigarettes possessed on the contrary a slightly fatty, buttery, caramel note. The smoke of the 'test'-cigarettes was moreover less harsh thanks to its enhanced fruity character.

EXAMPLE 6

A tobacco flavoring composition for 'kretek' type cigarettes essentially consisting of eugenol was added at a concentration of 8% by weight to an emulsion prepared according to example 5. A tobacco mixture was then flavored according to the procedure described in example 1.

The subsequently carried out evaluation on the resulting cigarettes indicated that 'control'-cigarettes developed a smoke with fuller aroma and enhabced diffusiveness by comparison with 'test'-cigarettes manufactured by tobacco flavored with an alcoholic solution of the same flavor.

An evaluation was repeated after 20 weeks. No noticeable difference of results was observed.

EXAMPLE 7

A 20% solution of menthol in a 1:1 mixture of ethanol and propylene glycol was incorporated into an emulsion prepared as described in example 5. The concentration used was of 25 parts of menthol solution for 100 parts of the emulsion. Following the procedure described in example 1, an american-blend tobacco was aromatized by using 100 g of flavoring emulsion for 1 kg of tobacco.

The thus flavored tobacco was stored for 8 weeks and used then to manufacture 'test'-cigarettes whose smoke was evaluated as described above by comparison with 'control'-cigarettes flavored with a solution of menthol in 95% ethanol.

The aroma of the 'test'-cigarettes was found to be more distinct than that of the 'control'-cigarettes.

An aroma evaluation was repeated after 20 weeks. The panel of tasters indicated a clear preference for the 'test'-cigarettes.

EXAMPLE 8

A comparative evaluation was carried out as indicated in previous example 7. The emulsion used was however prepared by mixing the following ingredients (parts by weight):

| | |
|---|---|
| Gum arabic | 12 |
| Malto-dextrin(1) (Maltrin-Glucidex, registered tradename) | 100 |
| Manucol(2) LF | 2 |
| Capsul(3) | 100 |
| Arlacel(4) 20 | 50 |
| Demineralized water | 736 |
| Total | 1000 |

(1) to (4) see example 5

The aroma developed by the 'test'-cigarettes is essentially similar to that obtained by using the flavored emulsion of previous example 7.

In all the above examples the emulsion was prepared as follows:

In a vessel of proper volume, water was slowly stirred by means of a magnetic or a helicoidal stirrer. The solid components consisting of the hydrosoluble carrier (such as starch, dextrins or alignates) are then slowly added to it portionwise. The carrier swells and then gradually dissolves at room temperature, whereupon the emulsifier at first and the flavoring composition was added to the resulting aqueous solution and stirring was kept until a fine and homogeneous emulsion is formed.

What we claim is:

1. A process for the aromatization of tobacco in a form selected from among leaves, particles, powders and films of natural or artificial origin by a volatile, water-immiscible active flavor, which process comprises intimately contacting said flavor with the tobacco by directly spraying onto an exposed surface thereof an emulsion consisting of the flavor, an aqueous solution of a hydrosoluble carrier and an emulsifier.

2. Process according to claim 1, wherein the hydrosoluble carrier is polyvinyl acetate, polyvinyl alcohol, a dextrin, a starch, a gelatine, a vegetal gum, a protein, an alginate, a carrageenan, a pectin, a xanthane, carboxymethylcellulose, methylcellulose or hydroxycellulose.

3. Process according to claim 1 wherein the emulsifier is a mono- or a diglyceride of a fatty acid, an ester of a fatty acid with sorbitol or with a saccharide, or an ester derivative of tartaric acid, citric acid, ascorbic acid or lactic acid.

4. Process according to claim 1 wherein the emulsion comprises by weight:

a. from 0.5 to 20% of the active flavor,
b. from 5 to 30% of the hydrosoluble carrier,
c. from 0.1 to 10% of the emulsifier, and
d. the remainder is water.

5. Process according to claim 1 wherein the emulsion is used at a concentration of 5 to 15% by weight based upon the weight of the treated tobacco.

6. Smoking or chewing article essentially consisting of a tobacco material flavored in accordance with the process of claim 1.

* * * * *